US009455069B2

(12) United States Patent
Holzmueller et al.

(10) Patent No.: US 9,455,069 B2
(45) Date of Patent: Sep. 27, 2016

(54) POWER CABLE SYSTEM

(75) Inventors: Jason Holzmueller, Lawrence, KS (US); Sophie Govetto, St Lawrence, KS (US); William Goertzen, Lawrence, KS (US); Mark A. Metzger, Lawrence, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/556,210

(22) Filed: Jul. 24, 2012

(65) Prior Publication Data

US 2014/0027152 A1 Jan. 30, 2014

(51) Int. Cl.

| | |
|---|---|
| ***H01B 7/12*** | (2006.01) |
| ***F04B 47/06*** | (2006.01) |
| ***H01B 7/04*** | (2006.01) |
| ***H01B 3/44*** | (2006.01) |
| *H01B 13/08* | (2006.01) |
| *H01B 7/02* | (2006.01) |

(52) U.S. Cl.

CPC ..... *H01B 7/046* (2013.01); *H01B 3/445* (2013.01); *H01B 7/0216* (2013.01); *H01B 13/0891* (2013.01); *Y10T 29/49117* (2015.01)

(58) Field of Classification Search

CPC ..... F04B 47/06; H01B 7/1895; H01B 7/02; H01B 3/30; H01B 13/06; H01B 9/00; B32B 7/12

USPC ..... 174/113 R, 103, 110 R, 102 R, 120 R

See application file for complete search history.

(56) References Cited

U.S. PATENT DOCUMENTS

| | | | | |
|---|---|---|---|---|
| 5,043,530 | A * | 8/1991 | Davies | H01B 7/1895 174/102 R |
| 6,337,443 | B1 * | 1/2002 | Dlugas et al. | 174/120 R |
| 2002/0062984 | A1 | 5/2002 | Dlugas | |
| 2003/0062190 | A1 * | 4/2003 | Kim et al. | 174/149 R |
| 2005/0013998 | A1 * | 1/2005 | Lacourt | B32B 7/12 428/377 |
| 2010/0147505 | A1 * | 6/2010 | Manke | F04B 47/06 166/66.4 |
| 2012/0063934 | A1 * | 3/2012 | Rumbaugh | F04B 47/06 417/410.1 |
| 2013/0206452 | A1 | 8/2013 | Janah et al. | |

FOREIGN PATENT DOCUMENTS

| | | |
|---|---|---|
| EP | 2557572 | 2/2013 |
| WO | 2008/099292 | 8/2008 |

OTHER PUBLICATIONS

Combined search and examination report for the equivalent GB patent application No. 1313127.1 issued on Jan. 22, 2014.

* cited by examiner

*Primary Examiner* — Jenny L Wagner
*Assistant Examiner* — Michael P McFadden
(74) *Attorney, Agent, or Firm* — Michael Stonebrook

(57) ABSTRACT

A technique facilitates the provision of electrical power in harsh environments, such as subterranean environments. The technique employs a power cable having at least one conductor and a polyimide insulation layer disposed about the conductor. A fluoropolymer tape layer is disposed about the polyimide insulation layer. The fluoropolymer tape layer is processed into a uniform, bonded layer. Additional cable layers also may be employed to help provide protection in the harsh environment.

17 Claims, 3 Drawing Sheets

POWER CABLE SYSTEM

BACKGROUND

Power cables are employed in a variety of subterranean applications. For example, power cables are used to supply power to electric submersible pumping systems deployed in wellbores for pumping fluid, such as petroleum or other production fluids. In some wellbore applications, the power cable is subjected to harsh conditions, including high temperatures and high pressures. Over time, the power cable insulation tends to degrade and the degradation eventually causes cable failure, thus limiting the lifetime of the electric submersible pumping system. In many of these applications, the insulation layer of the electric submersible pumping system cable is subjected to severe external conditions as well as severe internal conditions, e.g. high heat generated by the cable conductor. Additionally, the insulation can be subjected to voltage stress and may eventually come into contact with well fluid or gases.

SUMMARY

In general, the present disclosure provides a system and methodology for supplying electrical power in harsh environments, such as subterranean environments. The system and methodology employ a power cable having at least one conductor. A polyimide insulation layer is disposed about the conductor. Additionally, a fluoropolymer tape layer is disposed about the polyimide insulation layer. The fluoropolymer tape layer is processed into a uniform, bonded layer. Additional cable layers also may be employed to help provide protection in the harsh environment.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
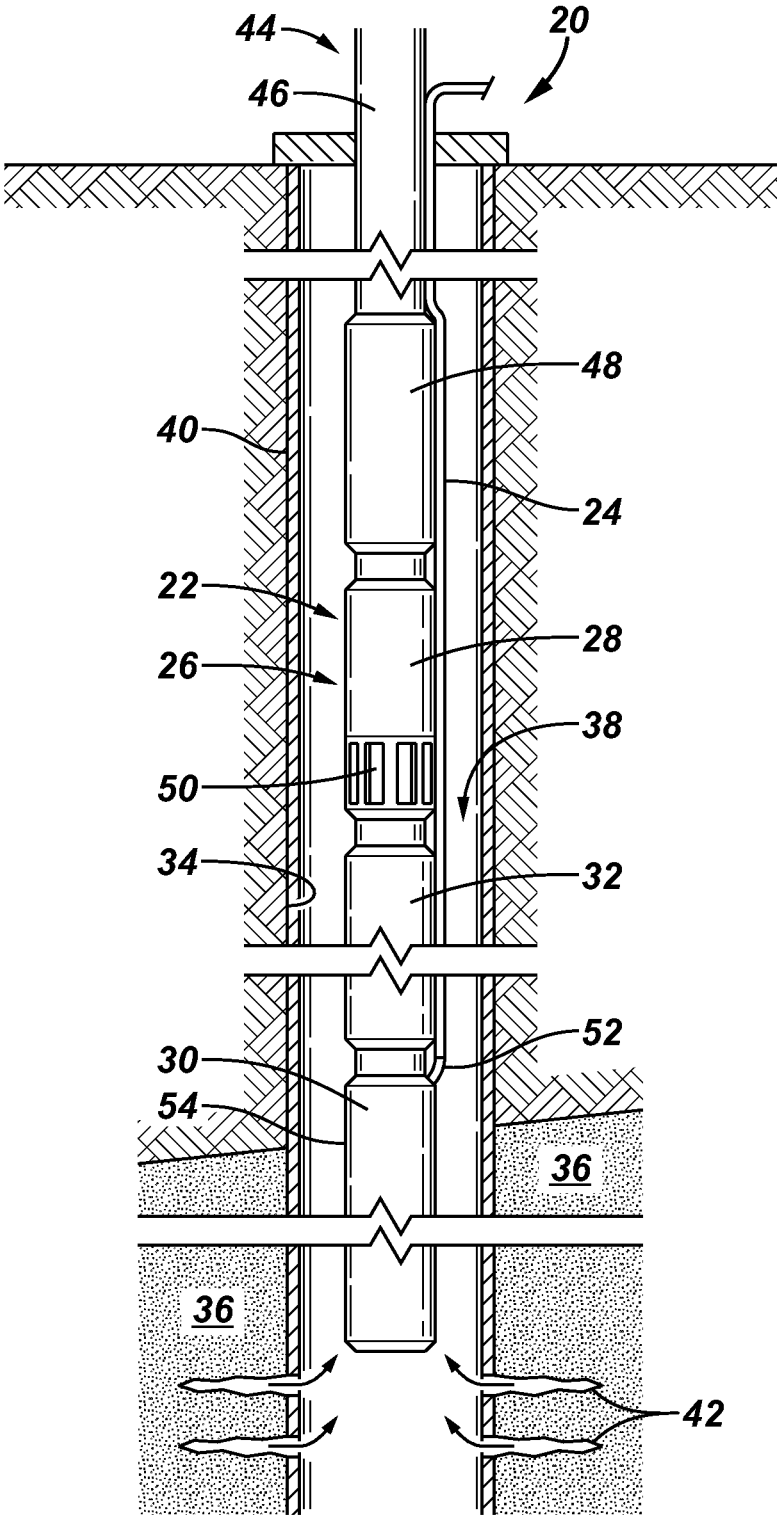
FIG. 1 is a front elevation view of an embodiment of an electric submersible system which receives power through a power cable, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to supplying electrical power in harsh environments, such as subterranean environments. The technique comprises creating a power carrier system, e.g. a power cable system, for delivering electrical power during relatively long-term applications in the harsh environments. By way of example, the power cable system comprises at least one electrical conductor, and each conductor is surrounded by a polyimide insulation layer which may be in the form of a tape wrapped around the conductor. In some applications, the polyimide insulation layer is wrapped directly onto the conductor and may utilize adhesive on one side or on both opposing surfaces. The polyimide insulation layer is surrounded by a second insulation layer, e.g. a tape wrapped in one or more layers around the polyimide insulation layer and then processed to create a uniform, bonded layer. For example, the second insulation layer may comprise a fluoropolymer tape disposed about the polyimide insulation layer. This fluoropolymer tape is then sintered via elevated temperature and/or pressure to create the uniform, bonded layer in a manner that reduces or removes porosity. According to a specific example, the fluoropolymer tape comprises a polytetrafluoroethylene (PTFE) tape, and the sintering process involves heating the PTFE tape above its melting point to create the bonded, continuous layer.

Effectively, each electrical conductor of the power cable is protected by a two component insulation system. The first component is the polyimide tape which may be wrapped around and bonded to the electrical conductor with an adhesive. In various embodiments, the polyimide tape serves as a primary dielectric layer in the cable. In some applications, the polyimide tape is used with adhesive on at least one surface and sometimes on both opposing surfaces, and the adhesive may comprise high temperature fluoropolymer or polyimide adhesive. In some applications, the adhesive may comprise a blend of different fluoropolymers, e.g. PTFE and perfluoroalkoxy (PFA), and/or other bondable materials having sufficiently high temperature resistance. The bonded polyimide tape creates a continuous, non-melting high dielectric strength layer. The non-melting characteristic of the polyimide tape enables it to endure high temperature excursions without softening or deforming, thus increasing the robustness of the power cable design. The number of layers of polyimide tape and the wrap design can vary depending on the cable voltage rating and on the tape thickness, however several types of tapes, tape thicknesses, wrap overlap amounts, wrap directions, and other taping variations may be employed depending on the specifics of a given application.

The second component of the two component insulation system may comprise a high temperature fluoropolymer layer. The fluoropolymer layer provides additional dielectric material between the conductor and the ground plane. This layer also protects the primary dielectric layer, e.g. the polyimide tape layer, from well fluid that may have been able to penetrate additional outer layers of the power cable. As discussed above, an example of the fluoropolymer is a PTFE tape wrap which may be sintered. Fluoropolymers such as PTFE have high melt viscosity which prevents the material from flowing even after reaching its melt temperature. This characteristic limits the ability for extrusion, but the PTFE layer is readily formed with PTFE tape. The PTFE tape is wrapped around the electrical conductor and then heated above its melt point. In some applications, the PTFE tape also may be compressed during the sintering process. The heating/sintering process helps remove porosity and sinters the PTFE tape into a single uniform layer which provides substantial protection from well fluids and gases while presenting a more temperature resistant insulation layer.

According to an example, the two component insulation system may be used on power cables employed for used in downhole oilfield or geothermal applications. The design of the two component insulation system (including the sintering process applied to the outer insulation component) enables construction of a power cable for use in extreme, downhole environments where cable temperatures may reach and exceed 315° C. (600° F.). The two component insulation layer also substantially increases the protection afforded the internal electrical conductors against well fluids containing high levels of corrosive gas or other deleterious fluids.

Referring generally to FIG. 1, an example of a well system is illustrated as comprising an electric submersible pumping system deployed on a tubing string in a well. The well system can be used in a variety of well applications, including onshore applications and offshore applications. In this example, the well system is illustrated as deployed in a generally vertical wellbore, however the well system may be deployed in a variety of wells including various vertical and deviated wells. The embodiments described below may be employed to facilitate, for example, production and/or servicing operations in well applications, in geothermal applications, and in other types of applications in which electrical power is provided in harsh environments.

In the example illustrated in FIG. 1, a well system 20 is illustrated as comprising an electrically powered system 22 which receives electrical power via a power cable 24. By way of example, the electrically powered system 22 may be in the form of an electric submersible pumping system 26, and the power cable 24 is designed to withstand high temperature, harsh environments. Although the electric submersible pumping system 26 may have a wide variety of components, examples of such components comprise a submersible pump 28, a submersible motor 30, and a motor protector 32.

In the example illustrated, electric submersible pumping system 26 is designed for deployment in a well 34 located within a geological formation 36 containing, for example, petroleum or other desirable production fluids. A wellbore 38 may be drilled and lined with a wellbore casing 40, although the electric submersible pumping system 26 (or other type of electrically powered system 22) may be used in open hole wellbores or in other environments exposed to high temperatures and harsh conditions. In the example illustrated, however, casing 40 may be perforated with a plurality of perforations 42 through which production fluids flow from formation 36 into wellbore 38. The electric submersible pumping system 26 may be deployed into a wellbore 38 via a conveyance or other deployment system 44 which may comprise tubing 46, e.g. coiled tubing or production tubing. By way of example, the conveyance 44 may be coupled with the electrically powered system 22 via an appropriate tubing connector 48.

In the example illustrated, electrical power is provided to submersible motor 30 by power cable 24. The submersible motor 30, in turn, powers submersible pump 28 which draws in fluid, e.g. production fluid, into the pumping system through a pump intake 50. The fluid is produced or moved to the surface or other suitable location via tubing 46. However, the fluid may be pumped to other locations along other flow paths. In some applications, for example, the fluid may be pumped along an annulus surrounding conveyance 44. In other applications, the electric submersible pumping system 26 may be used to inject fluid into the subterranean formation or to move fluids to other subterranean locations.

As described in greater detail below, the electric power cable 24 is designed to consistently deliver electric power to the submersible pumping system 26 over long operational periods in environments subject to high temperatures, high pressures, deleterious fluids, and/or other harsh conditions. The power cable 24 is connected to the corresponding, electrically powered component, e.g. submersible motor 30, by a suitable power cable connector 52, e.g. a suitable pothead. The cable connector 52 provides sealed and protected passage of the power cable conductor or conductors through a housing 54 of submersible motor 30. Depending on the application, the power cable 24 may comprise an individual electrical conductor protected by the insulation system or a plurality of electrical conductors protected by the insulation system. In various submersible pumping applications, the submersible motor 30 may be powered by three-phase current delivered through three electrical conductors.

Figure 2:
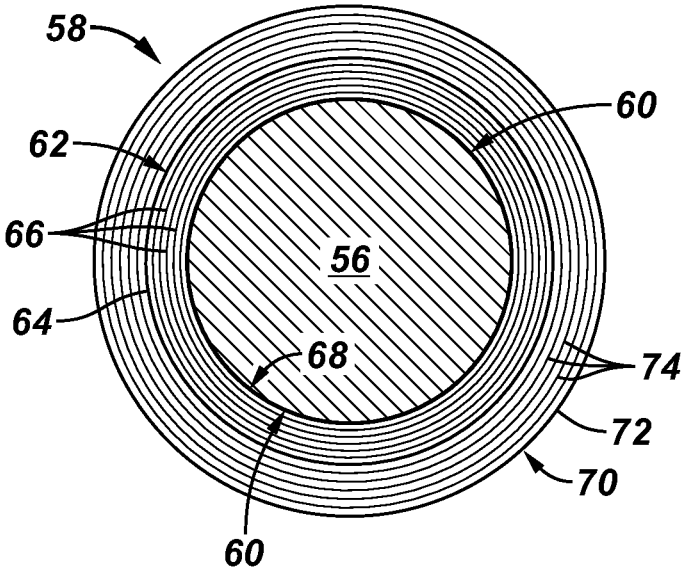
FIG. 2 is a cross-sectional view of an example of an insulated conductor which may be employed in the power cable, according to an embodiment of the disclosure.
Figure 3:
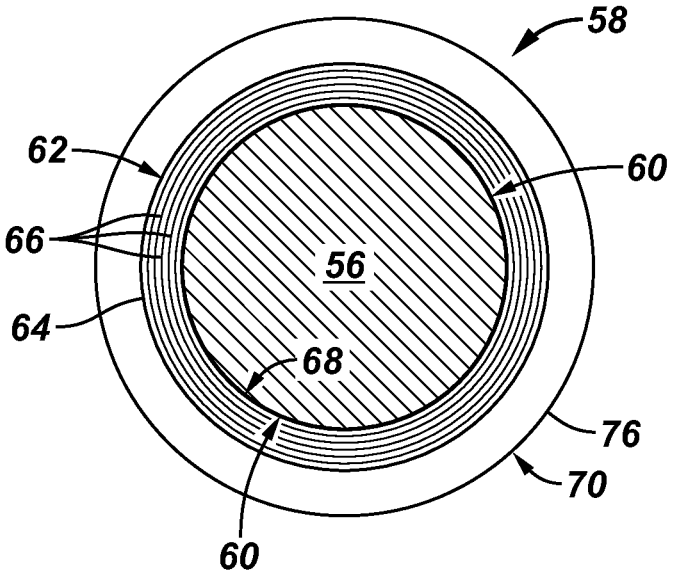
FIG. 3 is a cross-sectional view similar to that of FIG. 2 but showing at least one section of the conductor insulation tape processed into a bonded, continuous layer, according to an embodiment of the disclosure.

Referring generally to FIGS. 2 and 3, an example of a power cable conductor 56 protected by an insulation system 58 is illustrated. In this example, the conductor 56 is an electrical conductor which may be formed of a conductive metal. For example, conductor 56 may be formed of high purity copper and may be solid, stranded, or compacted stranded. In some applications, the stranded and compacted stranded conductors provide improved flexibility. Additionally, the conductor 56 may be coated with a corrosion resistant coating 60 designed, for example, to protect against conductor degradation from hydrogen sulfide gas which is commonly present in downhole environments. Examples of coating 60 include tin, lead, nickel, silver, or other suitable corrosion resistant metals, alloys, or other materials.

The insulation system 58 may be a two component insulation system which provides great resistance to high temperatures and other deleterious conditions in subterranean environments or other harsh environments. By way of example, the insulation system 58 comprises a first component 62 which may be in the form of a polyimide tape 64 wrapped around the conductor 56. In some applications, the polyimide tape 64 is wrapped directly onto conductor 56 in a plurality of layers 66. An adhesive 68 may be applied to at least one surface of the polyimide tape 64, e.g. an inner surface, or to both opposing surfaces of the polyimide tape 64. As described above, the adhesive 68 may comprise a high temperature fluoropolymer adhesive, polyimide adhesive, a blend of different fluoropolymers, or other bondable materials with sufficiently high temperature resistance. The adhesive 68 is combined with the polyimide tape 64 to create a non-melting high dielectric strength layer. The polyimide tape 64 may have a variety of forms, including various polyimide films. Other examples of polyimide tape 64 comprise hydrolysis resistant films for improved performance in certain environments. Additionally, the polyimide tape 64 may comprise corona resistant films for improved thermal conductivity and discharge resistance in higher amperage or higher voltage applications. Various specialty films may be available from polyimide film manufacturers, such as the DuPont Corporation or Kaneka High-Tech Materials Inc. Additionally, the polyimide tape 64 may be in the form of a composite including the adhesive 68 on at least one of the tape surfaces. Various treatments, e.g. plasma treatments or etchings, may be applied to the polyimide tape to facilitate adherence to the adhesive and/or to the conductor 56.

Insulation system 58 also may comprise a second component 70 which may initially be in the form of a fluoropolymer tape 72 wrapped around each conductor 56 at a position external to the polyimide tape 64. By way of example, the fluoropolymer tape 72 may be wrapped directly onto the polyimide tape 64 in a plurality of layers 74, as illustrated in FIG. 2. In some applications, the fluoropolymer tape 72 comprises polytetrafluoroethylene (PTFE) tape which can be used to provide a high temperature fluoropolymer layer and to increase the amount of dielectric material between the conductor 56 and the ground plane. PTFE tape has a very high melting viscosity that prevents it from flowing even after reaching its melt temperature. The fluoropolymer tape 72 is sintered which, in this application, refers to heating the fluoropolymer tape 72 to a temperature above its melt point. In some applications, the sintering process also comprises compressing the fluoropolymer tape 72 by applying pressure. The sintering process removes porosity and transforms the fluoropolymer tape 72, e.g. PTFE tape, into a single uniform layer 76, as illustrated in FIG. 3.

In a specific example, the fluoropolymer tape 72 is a PTFE tape wrapped in multiple layers around the first component 62. During sintering of the PTFE tape, applied pressure and heat cause the tape layers 74 to transform into a bonded, continuous layer which is illustrated as the bonded, uniform layer 76 which no longer contains the individual tape layers 74. The PTFE sintering process also reduces or removes voids or air pockets that can be sources of partial discharge in the power cable 24. The fully bonded continuous layer 76 also reduces or prevents gas migration along the conductor 56 or between tape layers. The high melt temperature of the PTFE, e.g. 325-328° C., combined with its high crystallinity, resistance to melt flow, and stable dielectric properties enable the second component 70 to retain its functionality as a secondary dielectric layer at temperatures approaching and beyond its melt temperature.

Insulation system 58 combines these attributes of uniform layer 76 with the high dielectric strength and non-melting characteristics of the internal polyimide tape layer 64 to enable functional operation of the power cable 24 even when temperatures exceed the melting/degradation temperatures of other cable components. The fluid resistance of the PTFE layer 76, or other suitable fluoropolymer layer 76, enables the power cable 24 to continue functioning, at least for time, even if cable armor and/or barrier layers are damaged such that well fluid is able to enter the power cable. The uniform, sintered layer 76 also serves as a fluid and moisture barrier which can effectively protect the polyimide tape 64 against hydrolysis at high temperatures.

Depending on the application, power cable 24 may comprise an individual conductor 56 protected by an individual insulation system 58; or the power cable 24 may comprise a plurality of conductors 56 protected by a plurality of insulation systems 58. In the embodiment illustrated in FIG. 4, for example, the power cable 24 comprises three conductors 56, e.g. copper conductors, although other numbers of conductors 56 may be employed. Use of three conductors 56 facilitates carrying of three-phase power to submersible motor 30 or to other powered devices or systems.

Figure 4:
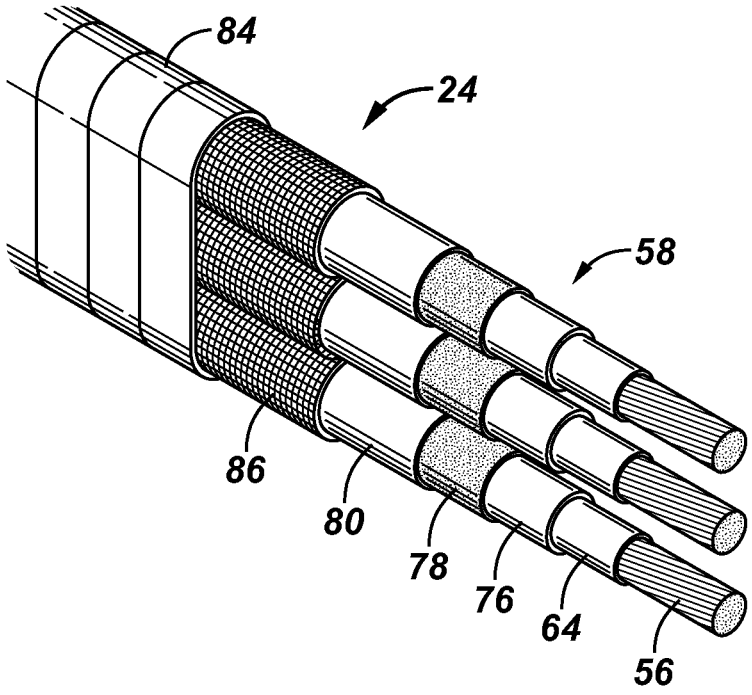
FIG. 4 is an orthogonal view of an example of a power cable having a plurality of insulated conductors, according to an embodiment of the disclosure.

In the example illustrated in FIG. 4, each conductor 56 is wrapped with polyimide tape 64 to form the polyimide insulation layer of first component 62. The fluoropolymer tape is sintered into the uniform layer 76 around each conductor 56 and is located externally with respect to the polyimide insulation layer tape 64 to form the two component insulation system 58. However, the power cable 24 may comprise a variety of other components. For example, the power cable 24 may comprise a barrier layer 78 disposed around each bonded, uniform layer 76. The barrier layers 78 may be designed to reduce or prevent intrusion of corrosive downhole gases and fluids and may be formed of lead, e.g. a tube of lead, or of other corrosion resistant materials including alloys, e.g. stainless steel, monel™, or inconel™. In other applications, however, the barrier layers 78 may be formed of fluoropolymer or other suitable material. In some applications, the barrier layer or layers 78 may be formed of combinations of materials such as lead covered with a fluoropolymer layer 80, e.g. PTFE layer.

The power cable 24 also may comprise other or additional components suited to a specific cable design. In the round cable embodiment illustrated in FIG. 5, for example, the power cable 24 also may comprise a cable jacket 82. The cable jacket 82 provides a fluid, gas, and temperature resistant jacket and may be positioned around the plurality of conductors individually or collectively. For example, the cable jacket 82 may be formed as separate components or as a unitary component surrounding the insulation systems 58. The cable jacket 82 provides additional protection in extreme downhole environments and other harsh environments. By way of example, the cable jacket 82 may comprise at least one layer of fluoropolymer, polyetheretherketone (PEEK), elastomer, and/or other materials resistant to the harsh environmental conditions.

Figure 5:
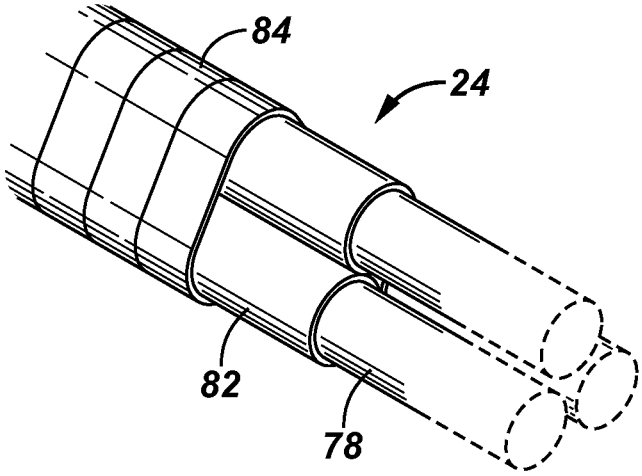
FIG. 5 is an orthogonal view of another example of a power cable having a plurality of insulated conductors, according to an embodiment of the disclosure.

Referring again to the embodiments illustrated in FIGS. 4 and 5, the power cable 24 also may comprise a layer of cable armor 84. The cable armor 84 may be constructed from a variety of materials, such as galvanized steel, stainless steel, Monel, or other suitable metals, metal alloys, and/or non-metal materials able to provide suitable protection. In some applications, an intermediary layer 86 is disposed directly inward of the cable armor 84 to prevent damage to other cable components as the cable armor 84 is wrapped or otherwise formed along the exterior of the power cable 24. By way of example, the intermediary layer 86 may comprise tape, fabric, braided material, or other suitable material wrapped around the conductors 56 individually or collectively. It should be noted, however, that a variety of other and/or additional layers and components, formed of a variety of materials, may be used in power cable 24 for a given application.

The ability of the two component insulation systems 58 to provide enhanced protection of the conductors 56 facilitates long-term use of the power cable 24 in a variety of harsh environments. For example, the power cable 24 may be employed in harsh, downhole environments, such as steam assisted gravity drainage (SAGD) wells. The high temperature cable 24 also may be employed in high temperature steam flood or geothermal wells as well as in highly corrosive or gassy environments. The high temperature capability of the power cable 24 also enables operation of the cable in applications with high amperage requirements which lead to high heat conditions along the conductors 56.

Although the design of power cable 24 facilitates use in a variety of well related applications, the power cable 24 is amenable to operation in many other types of environments and applications. For example, the power cable 24 may be used in harsh subterranean environments as well as harsh environments above the Earth's surface. By way of example, the power cable is useful in oilfield applications, geothermal applications, subsea applications, industrial applications, power transmission applications, and other applications.

Depending on the systems, environment, and parameters of a given application, various embodiments described herein may be used to facilitate provision of electrical power in many types of operations. Accordingly, the overall well system or other powered system may comprise a variety of powered motors, tools, actuators, heaters, and other components or systems. In some applications, a plurality of cables may be employed, and each cable may comprise individual or plural conductors to provide the desired electrical power. Additionally, the cable may comprise a variety of materials, layers, components, and arrangements of components that cooperate with the two component insulation system. The two component insulation system also may comprise various materials, combinations of materials, layers of materials, and bonding materials.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A power cable system, comprising:

a power cable having:

a plurality of conductors;

a polyimide tape having a layer of adhesive comprising a fluoropolymer, the polyimide tape being wrapped around each conductor and bonded to the conductor with the layer of adhesive;

a bonded, continuous sintered fluoropolymer tape layer around and external to the polyimide tape, the sintered fluoropolymer tape layer having a reduced porosity relative to a non-sintered form of the fluoropolymer tape;

a barrier layer around each conductor, the barrier layer being external to the bonded, continuous layer;

an intermediary protective layer; and a cable armor layer disposed about the intermediary protective layer and the barrier layer.

2. The system as recited in claim 1, wherein the plurality of conductors comprises three conductors to carry three-phase current.

3. The system as recited in claim 2, further comprising a connector coupling the power cable to an electric submersible pumping system.

4. The system as recited in claim 1, wherein the adhesive is applied to opposing surfaces of the polyimide tape.

5. The system as recited in claim 1, wherein the barrier layer comprises lead.

6. The system as recited in claim 1, wherein the power cable further comprises a cable jacket, the cable jacket being external to the barrier layer.

7. The system as recited in claim 1, wherein the bonded, continuous layer comprises polytetrafluoroethylene (PTFE).

8. A method of constructing a power cable, comprising:

assembling a plurality of conductors for conducting electrical power;

surrounding each conductor with a polyimide tape;

wrapping a plurality of layers of fluoropolymer tape onto an external surface of the polyimide tape;

sintering the fluoropolymer tape while compressing the fluoropolymer tape to form the fluoropolymer tape into a bonded, continuous layer;

placing a barrier layer around each conductor, the barrier layer external to the bonded, continuous layer;

positioning an intermediary protective layer to protect the barrier layer; and providing a cable armor layer about the intermediary protective layer and the barrier layer.

9. The method as recited in claim 8, wherein assembling comprises assembling three conductors to carry three-phase electrical power.

10. The method as recited in claim 9, further comprising coupling the plurality of conductors to an electric submersible pumping system.

11. The method as recited in claim 8, wherein surrounding comprises wrapping each conductor directly with the polyimide tape and securing the polyimide tape with an adhesive.

12. The method as recited in claim 8, wherein wrapping comprises wrapping PTFE tape around each conductor.

13. The method as recited in claim 12, wherein sintering comprises sintering the PTFE tape.

14. A method for preparing a power carrier system, comprising:

providing a conductor;

applying adhesive to a polyimide insulation layer;

wrapping the polyimide insulation layer disposed about the conductor;

subsequently wrapping a plurality of fluoropolymer tape layers directly onto an external surface of the polyimide insulation layer;

compressing the fluoropolymer layer; and sintering the compressed fluoropolymer tape layer into a uniform, bonded layer to provide a two component insulation system having the polyimide insulation layer as a first component and the uniform, bonded layer as a second component disposed externally of the first component.

15. The method as recited in claim 14, further comprising pressurizing the fluoropolymer tape layer to remove voids and air pockets from the fluoropolymer tape layer.

16. A power cable formed according to the method of claim 8.

17. A power cable formed according to the method of claim 11.

* * * * *